United States Patent [19]

Sato et al.

[11] Patent Number: 5,029,828

[45] Date of Patent: Jul. 9, 1991

[54] CONTINUOUS PAPER FOLDING DEVICE FOR A PRINTING APPARATUS

[75] Inventors: Takao Sato, Hanamaki; Katumi Sugawara, Kitakami, both of Japan

[73] Assignee: Sinko Seisakusho Co., Ltd., Hanamaki, Japan

[21] Appl. No.: 444,972

[22] Filed: Dec. 4, 1989

[30] Foreign Application Priority Data

Dec. 6, 1988 [JP] Japan ..... 63-306986

[51] Int. Cl.[5] ..... B41L 1/32

[52] U.S. Cl. ..... 270/39; 493/410; 493/454

[58] Field of Search ..... 270/30, 31, 39; 493/409, 410, 416, 442, 454

[56] References Cited

U.S. PATENT DOCUMENTS 3,086,768 4/1963 Lach ..... 270/39
3,607,583 9/1971 Geschwender ..... 270/39

FOREIGN PATENT DOCUMENTS 262375 10/1988 Japan ..... 270/39
300077 12/1988 Japan ..... 270/39
1100210 6/1984 U.S.S.R. ..... 270/31

*Primary Examiner*—John T. Kwon
*Assistant Examiner*—Therese M. Newholm
*Attorney, Agent, or Firm*—Oblon, Spivak, McClelland, Maier & Neustadt

[57] ABSTRACT

A continuous paper folding device for a printing machine has a pair of thin elongated folding plates which are located at both sides of a paper transferring path for a continuous paper, provided by a plurality of transferring rollers and are arranged so as to be rotatable around the respective axes of rotation which extend in parallel to each other. When the pair of folding plates are operated by a driving motor, the folding plate are rotated in correspondence to rows of perforations formed in the continuous paper so that it is correctly folded in a zigzag form on a paper receiving table.

4 Claims, 3 Drawing Sheets

CONTINUOUS PAPER FOLDING DEVICE FOR A PRINTING APPARATUS

BACKGROUND OF THE INVENTION

The present invention relates to a folding device for a continuous paper having rows of perforations for folding at predetermined intervals, the folding device being preferably applicable to a printing apparatus or the like.

There have been known various types of folding devices for a continuous paper. One of the folding devices is disclosed in Japanese Unexamined Patent Publication 13054/1982. As shown in FIG. 6, the folding device is provided with an auxiliary transferring means and a sucking/ejecting means for sucking and ejecting air, which are located at both sides of a paper transferring path for a continuous paper 1 formed between the plurality of rollers 3, 3', and a paper receiving table. Namely, belts 6, 6' are respectively rotated by pulleys *7a*, *7b*, *7a'*, *7b'* rotated in the directions indicated by arrow marks at a speed faster than a speed of the rollers 3, 3' for transferring the continuous paper 1. Boxes 8, 8' are respectively provided inside the belts 6, 6' which are respectively between the pulleys *7a*, *7b*, *7a'*, *7b'*. Ducts 9, 9' are respectively connected to the boxes so that air is sucked into or ejected from the boxes by a blower or blowers. Reference numerals 10 designates switching between valves for switching sucking or ejecting of air through the ducts 9, 9'.

However, the conventional folding device has disadvantages as follows. The mechanism for controlling the switching valves 10 which repeats alternately the operations of sucking and ejecting air is complicated, and hence it invites a high manufacturing cost. Further, since the sucking/ejecting means consisting of the boxes 8, 8', the ducts 9, 9' and the blower 10 is installed in the auxiliary transferring means having the belts 6, 6' and the rollers *7a*, *7b*, *7a'*, *7b'*, the entire structure of the device is large.

SUMMARY OF THE INVENTION

It is an object of the present invention to eliminate the above-mentioned problems and to provide a folding device for a continuous paper which is simple in structure, not bulky, and capable of correctly folding a continuous paper so that it can be regularly placed on a receiving table.

The present invention provides a continuous paper folding device for a printing apparatus for folding a continuous paper in a zigzag form at rows of perforations provided at predetermined intervals in the continuous paper, including a plurality of transferring rollers for transferring the continuous paper, a pair of thin elongated folding plates which are located at both sides of a paper transferring path provided by the transferring rollers and arranged so as to be rotatable around the respective axes of rotation which extend in parallel to each other, and a driving means for turning the folding plates in the directions opposite to each other so that the folding plates are operated repeatedly to fold the continuous paper in a zigzag form at rows of perforations formed in the continuous paper moved along the paper transferring path.

DETAILED DESCRIPTION OF THE PREFERRED EMBODIMENT

A preferred embodiment of the continuous paper folding device of the present invention will be described with reference to the drawings.

Figure 1:
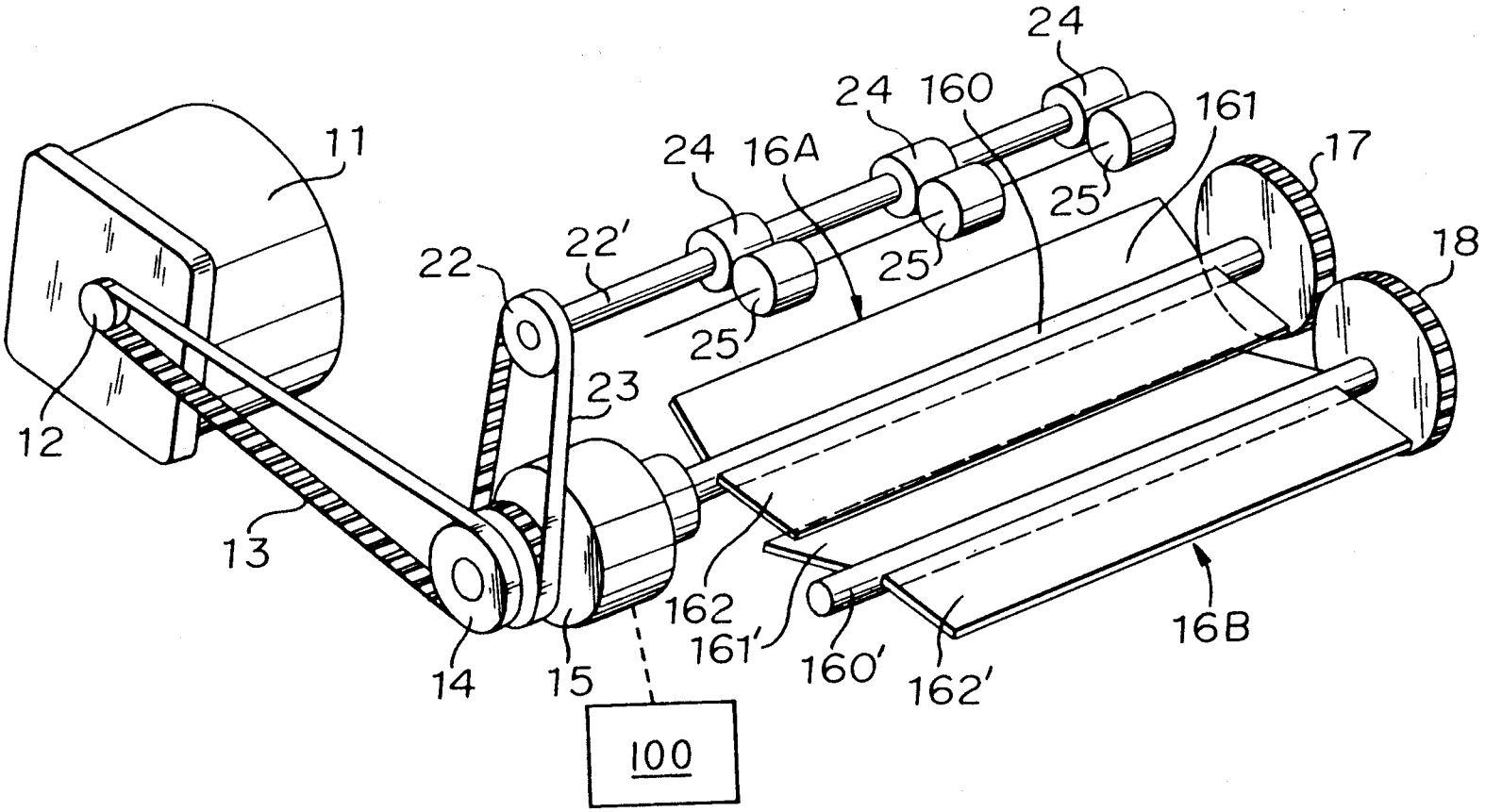
FIG. 1 is a perspective view showing an embodiment of the continuous paper folding device in accordance with the present invention.

FIG. 1 is a perspective view schematically showing an embodiment of the continuous paper folding device of the present invention.

The folding device of the present invention has a driving means comprising a motor 11, a pulley 12, a belt 13, a pulley 14 and a clutch 15, a pair of folding plates 16A, 16B and gear wheels 17, 18. The pair of folding plates 16A, 16B are respectively rotated in predetermined directions by a driving force generated from the motor 11 through the pulley 12, the belt 13, the pulley 14 and the clutch 15.

One folding plate 16A of the pair of folding plates 16A, 16B is provided with elongated plate portions 161, 162 which extend along a rotating shaft 160 and are attached to it so as to have an obtuse angle. The other folding plate 16B also has plate portions 161', 162' having the same construction as the folding plate 16A. A gear wheel 17 is attached to an end of the rotating shaft 160 and a gear wheel 18 is attached to an end of the rotating shaft 160' so that the gear wheels 17, 18 are meshed with each other Thus, when the motor 11 is actuated, the pair of folding plates 16A, 16B are rotated in the predetermined directions which are opposite to each other. The predetermined directions of rotation of the folding plates 16A, 16B mean such directions that the plate portions coming between the rotation shafts move downwardly.

Further, to attach the plate portions to the folding plates 16A, 16B at an obtuse angle with respect to their axes of rotation means that the edges of the plate portions, when they are at opposing positions, overlap at an appropriate distance during rotating operation, and that at a first time during the operation, the plate portion 161' is ahead of the plate portion 161 in the direction of rotation, and at a second time during the operation, the plate portion 162 is ahead of the plate portion 162' in the direction of rotation.

In a preferred embodiment, a common driving source (i.e. the motor 11) is used for both transferring rollers 24, 25 and the folding plate 16A, 16B. Namely, a pulley 22 is provided facing a pulley 14, and a belt 23 is extended between the pulleys 14, 22. A plurality of driving rollers 24 for transferring a continuous paper are attached to the shaft 22' of the pulley 22. A plurality of follower rollers 25 are arranged so as to face the driving rollers 24. Thus, a continuous paper 26 printed out by, for instance, an electrophotographic printer is passed between the rollers 24, 25 to be transferred. The continuous paper 26 has rows of perforations at predetermined intervals in the transverse direction of the paper.

Figure 3:
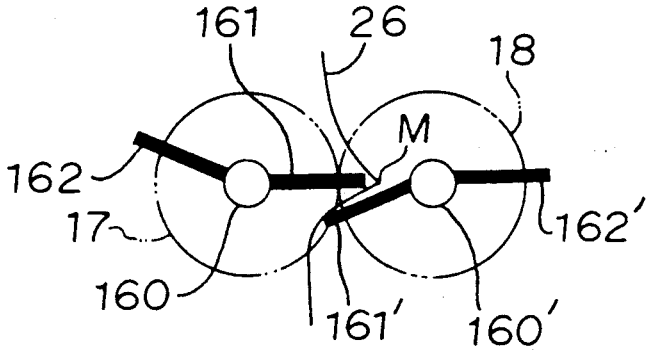
Figure 5:
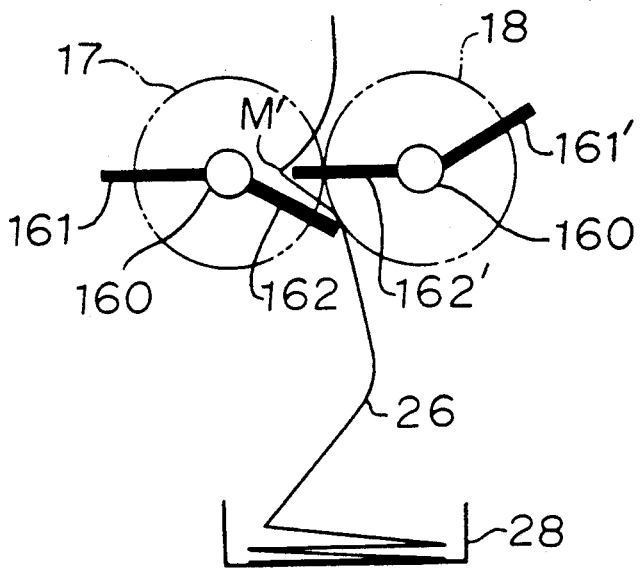
Figure 6:
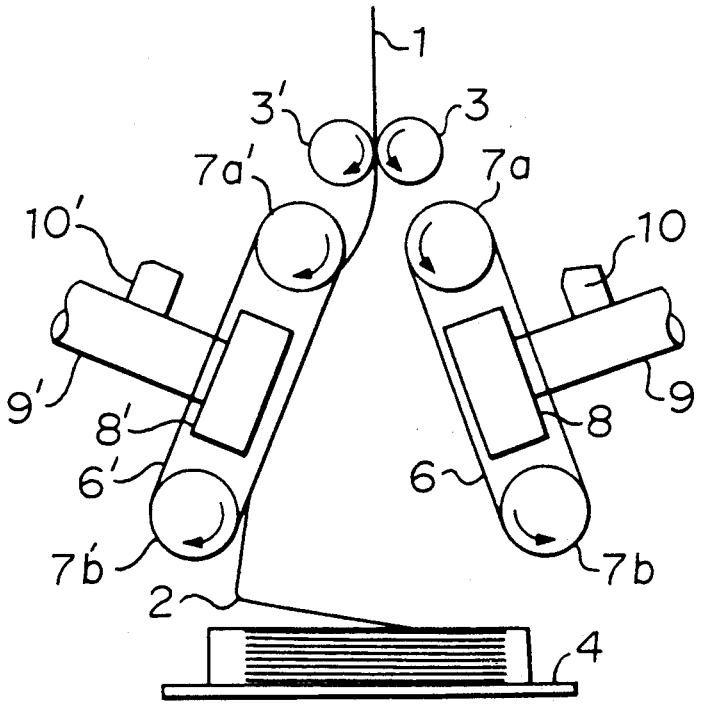
FIGURE 6 PRIOR ART
FIG. 6 is a diagram showing a conventional continuous paper folding device.

A ratio of the diameter of the pulley 14 to the diameter of the pulley 22 is so determined that when the folding plates 16A, 16B are first rotated by a predetermined quantity by means of the gear wheels 17, 18, a first row of perforations M of the continuous paper 26 has a positional relationship to the folding plates 16A, 16B as shown in FIG. 3, namely, a pair of the plate portions 161', 161 are brought to a positional relationship wherein they are close to each other and are overlapped. And then, when the folding plates 16A, 16B are rotated by further predetermined quantity, a second row of perforations M' of the continuous paper 26 is brought to a positional relationship as shown in FIG. 5, namely, a pair of the plate portions 162, 162' are brought to a positional relationship wherein they are close to each other and are overlapped.

Figure 2:
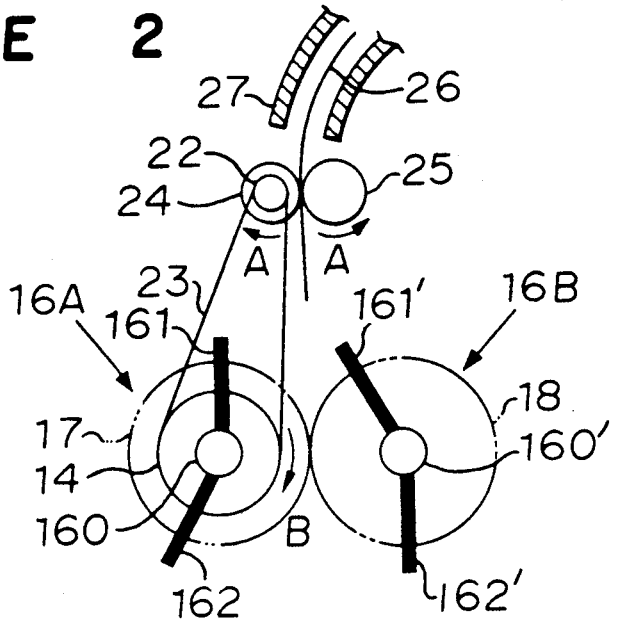
FIGS. 2 through 5 are respectively diagrams showing the operation of the folding device shown in FIG. 1.

In FIG. 2, a reference numeral 27 designates a transferring guide for the continuous paper. In FIG. 5, a reference numeral 28 is a continuous paper receiving table.

The folding device of the present invention further comprises, in addition to the construction as described above, control means 100 for generating a signal indicating the direction of folding a continuous paper along a row of perforations, which is arranged near the inlet for the continuous paper in a printing apparatus main body, and means for detecting the top edge of the continuous paper, although the signal generating means, the top end detecting means and the main body are not shown in the drawings. The clutch 15 is adapted to be engaged or disengaged on the basis of a signal from the signal generating means for indicating the direction of folding.

When the continuous paper 26 is transferred by a predetermined distance by an instruction from a control section (not shown) in the printing apparatus, the motor 11 is actuated to rotate the transferring rollers 24, 25 in the direction of arrow mark A (FIG. 2) through the pulleys 12, 14, 22 and the belts 13, 23, whereby the continuous paper 26 is transferred in the direction between the folding plate 16A, 16B.

The folding plate 16A is rotated along with the rotating shaft 160 in the direction of arrow mark B in FIG. 2 by the coupling operation of the clutch 15 which is actuated by a signal from the signal generating means for generating an instruction of the direction of folding of the continuous paper along a row of perforations. At that moment, the rotating shaft 160' is rotated in the opposite direction by the gear wheel 18 which is attached to an end of the rotating shaft 160 and is meshed with the gear wheel 17, whereby the folding plate 16B fixed to the rotating shaft 160' is also rotated.

During the rotation, the plate portion 161' is rotated slightly ahead of the plate portion 161 as shown in FIGS. 2 and 3. Accordingly, the continuous paper 26 is folded in one direction, i.e. in the direction to form a valley in the continuous paper 26 in the transversal direction when a surface of the continuous paper is viewed from the left side in FIG. 3.

Figure 4:
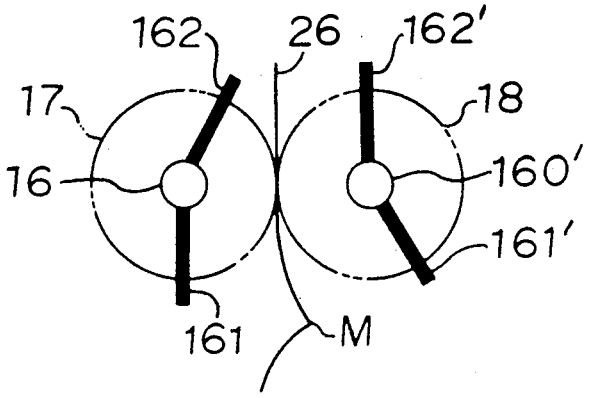

As soon as the folding operation as shown in FIG. 3 is finished, the clutch 15 is disengaged, whereby each of the plate portions 161, 162, 161', 162' are maintained at positions as shown in FIG. 4.

When the continuous paper 26 is advanced again, the clutch 15 is actuated by a signal from the signal generating means for instructing the direction of folding of the continuous paper, and the folding plates 16A, 16B are rotated in the same manner as described before. During the rotation, the plate portion 162 is rotated slightly ahead of the plate portion 162' as shown in FIG. 5. Accordingly, the continuous paper 26 is folded in the other direction, i.e. in the direction to form a ridge in the continuous paper in the transversal direction when viewed from the left side in FIG. 3.

Thus, by repeating the above-mentioned operations, the continuous paper 26 is folded in a zigzag form at the rows of perforation and put correctly on the paper receiving table 28.

As described above, the folding device for a continuous paper of the present invention is simple in structure wherein the pair of folding plates which are rotated in the directions opposite to each other are arranged at both sides of a paper transferring path formed by a plurality of transferring rollers, and a clutch is provided so as to operate upon receiving a control signal. Accordingly, the number of structural elements can be reduced, hence the manufacturing cost is low. Further, the direction of folding can be certainly given to the continuous paper and the reliability on the folding device is high. It is unnecessary to watch whether or not the continuous paper emitted from the printing apparatus is regularly folded. Accordingly such a troublesome work can be eliminated. Further, the folding device of the present invention reduces noises and it is applicable to a high speed printing apparatus.

What is claimed is:

1. A paper folding device for folding a continuous paper in a zigzag form at rows of perforations provided at predetermined intervals in the continuous paper, comprising:

a plurality of transferring rollers for transferring the continuous paper along a paper transferring path;

folding means positioned for receiving paper transferred from said transferring rollers, said folding means comprising two folding plates respectively positioned at opposite sides of said paper transferring path and rotatable about parallel axes, each of said folding plates comprising two plate portions mutually spaced by an obtuse angle such that for each rotation of said folding plates about said parallel axes, plate portions of said folding plates first overlap one another with a plate portion of one of said folding plates leading a plate portion of the other of said folding plates and plate portions of said folding plates then overlap one another with a plate portion of the other of said folding plates leading a plate portion of said one of said folding plates;

driving means including a clutch for rotating said folding plates about said axes; and control means for intermittently engaging said clutch.

2. The continuous paper folding device for a printing apparatus according to claim 1, wherein the driving means further comprises a motor, said clutch being provided on the rotary shafts of the motor and one of the folding plates, and a pair of gear wheels attached to each one end of the folding plates to be meshed with each other.

3. The continuous paper folding device for a printing apparatus according to claim 2, wherein said motor is used commonly for the transferring rollers and the folding plates.

4. The device of claim 1 wherein said control means comprises means for generating a signal indicating the direction of folding of the continuous paper.

* * * * *